US005382170A

United States Patent [19]

Imanishi

[11] Patent Number: 5,382,170

[45] Date of Patent: Jan. 17, 1995

[54] COUPLING CONSTRUCTION

[75] Inventor: Hisao Imanishi, Yokkaichi, Japan

[73] Assignee: Sumitomo Wiring Systems, Ltd., Yokkaichi, Japan

[21] Appl. No.: 83,506

[22] Filed: Jun. 30, 1993

[30] Foreign Application Priority Data

Jul. 16, 1992 [JP] Japan ..... 4-189186

[51] Int. Cl.[6] ..... H01R 13/434

[52] U.S. Cl. ..... 439/127; 123/169 PH; 439/336

[58] Field of Search ..... 439/125, 129, 130, 835, 439/836, 846–848; 123/169 PH

[56] References Cited

U.S. PATENT DOCUMENTS 3,223,963 12/1965 Rarey et al. ..... 439/847 X
4,997,380 3/1991 Etienne et al. ..... 439/835 X

FOREIGN PATENT DOCUMENTS 2143434 3/1973 Germany ..... 439/848
64-8580 1/1989 Japan .
3264776 11/1991 Japan .

OTHER PUBLICATIONS

Partial English Language descriptions to Japanese Patent Publications Nos. 64–8580 and 3–264776.

*Primary Examiner*—Eugene F. Desmond
*Attorney, Agent, or Firm*—Sandler Greenblum & Bernstein

[57] ABSTRACT

A coupling construction for coupling a high-voltage terminal of an ignition coil for use in an internal combustion engine and an electric conductor with each other. The high-voltage terminal is inserted into the electric conductor. An engaging ring engages the peripheral surface of the electric conductor. An engaging convex portion of the engaging ring projecting inward toward the high-voltage terminal through a through-hole engages the engaging concave portion of the high-voltage terminal due to the contraction of the engaging ring. After the high-voltage terminal and the electric conductor are coupled with each other, a moving sleeve engages the peripheral surface of the engaging ring, thereby preventing the diameter of the engaging convex portion of the engaging ring from expansionarily increasing more than a predetermined length.

6 Claims, 4 Drawing Sheets

COUPLING CONSTRUCTION

BACKGROUND OF THE INVENTION

1. Field of the Invention

The present invention relates to a coupling construction and more particularly to the coupling construction preferable for connecting a high voltage terminal of an ignition coil for use in an internal combustion engine and an electric conductor with each other.

2. Description of the Related Arts

An example of the internal combustion engine disclosed in Japanese Laid-Open Utility Model Publication No. 64-8580 is described below with reference to FIG. 4. An electric conductor 5 is engaged by the inner peripheral surface of an insulating member 4 with the insulating member 4 installed on an installing hole 3 formed in a cylinder head 2. A terminal 6 mounted above the electric conductor 5 is urged by a spring 7 so as to bring the terminal 6 into contact with a high-voltage terminal 9 of an ignition coil 8 inserted into an upper portion of the insulating member 4. At the same time, a terminal 10 provided at a lower portion of the electric conductor 5 is urged by a spring 11 so as to bring the terminal 10 into contact with a terminal 13 of an ignition plug 12 inserted into a lower portion of the insulating member 4.

In the above-described ignition device, it is necessary to increase electrical sealing performance between the insulating member 4 and the ignition plug 12 with the rise of a required voltage. To this end, the inner diameter of the insulating member 4 is set to be small for the insulating member 4 to tighten an insulating portion 12*a* of the ignition plug 12 strongly.

In the construction of the above-described ignition device, the ignition coil 8 and the electric conductor 5 can be uncoupled from each other. Therefore, when the ignition coil 8 is moved upward by hand in removing the ignition device from an engine 1, the ignition coil 8 is uncoupled from the insulating member 4 before the insulating member 4 is uncoupled from the ignition plug 12. This is because the ignition plug 12 is strongly tightened by the insulating member 4. As a result, the insulating member 4 or the electric conductor 5 remains disposed in the installing hole 3 of the engine 1.

It is conceivable that the ignition coil 8 is tightened by the insulating member 4 to a greater extent. But the force of inserting the ignition coil 8 is increased and thus the operation of inserting the ignition coil 8 into the insulating member 4 is inefficiently performed. It is also conceivable that the ignition coil 8 is adhered to the insulating member 4. But it is impossible to replace other parts.

SUMMARY OF THE INVENTION

It is an object of the present invention to provide a coupling construction in which a shaft member (terminal of ignition coil) can be efficiently installed on a cylindrical member (electric conductor) with the former inserted into the latter.

In accomplishing this and other objects, there is provided a coupling construction for coupling a shaft member (shaft-shaped high-voltage terminal of an ignition coil for use in an internal combustion engine) and a cylindrical member (cylindrical electric conductor) with each other with the shaft member (high-voltage terminal) inserted into the cylindrical member (cylindrical electric conductor), comprising: an engaging concave portion formed on the peripheral surface of the shaft member (high-voltage terminal); a through-hole, formed on the cylindrical member (cylindrical electric conductor), corresponding to the engaging concave portion of the shaft member (high-voltage terminal); an engaging ring which engages the peripheral surface of the cylindrical member (cylindrical electric conductor) and has an engaging convex portion projecting inward toward the shaft member (high-voltage terminal) through the through-hole and engaging the engaging concave portion of the shaft member (high-voltage terminal) due to the contraction of the engaging ring; and a moving sleeve, for preventing the diameter of the engaging convex portion of the engaging ring from expanding, movable between a locking position at which the moving sleeve engages the peripheral surface of the engaging ring and an unlocking position at which the moving sleeve disengages therefrom.

According to the above-described construction, the shaft-shaped high-voltage terminal is inserted into the cylindrical electric conductor. The engaging ring engages the peripheral surface of the electric conductor. The engaging convex portion of the engaging ring projecting inward toward the high-voltage terminal through the through-hole engages the engaging concave portion of the high-voltage terminal due to the contraction of the engaging ring. The moving sleeve engages the peripheral surface of the engaging ring with the high-voltage terminal and the electric conductor coupled with each other, thereby preventing the diameter of the engaging convex portion of the engaging ring from expanding or increasing more than a predetermined length. Accordingly, engaging convex portion of the engaging ring can be prevented from disengaging from the engaging concave portion of the high-voltage terminal.

In this construction, when the high-voltage terminal is moved upward by hand, the engaging convex portion of the engaging ring is locked by the moving sleeve so that the engaging convex portion does not disengage from the engaging concave portion of the high-voltage terminal. Accordingly, the high-voltage terminal is not uncoupled from the electric conductor. In inserting the high-voltage terminal into the electric conductor, the moving sleeve is placed at the unlocking position. Therefore, the force of inserting the high-voltage terminal into the electric conductor is not increased and thus high-voltage terminal can be efficiently inserted into the electric conductor.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
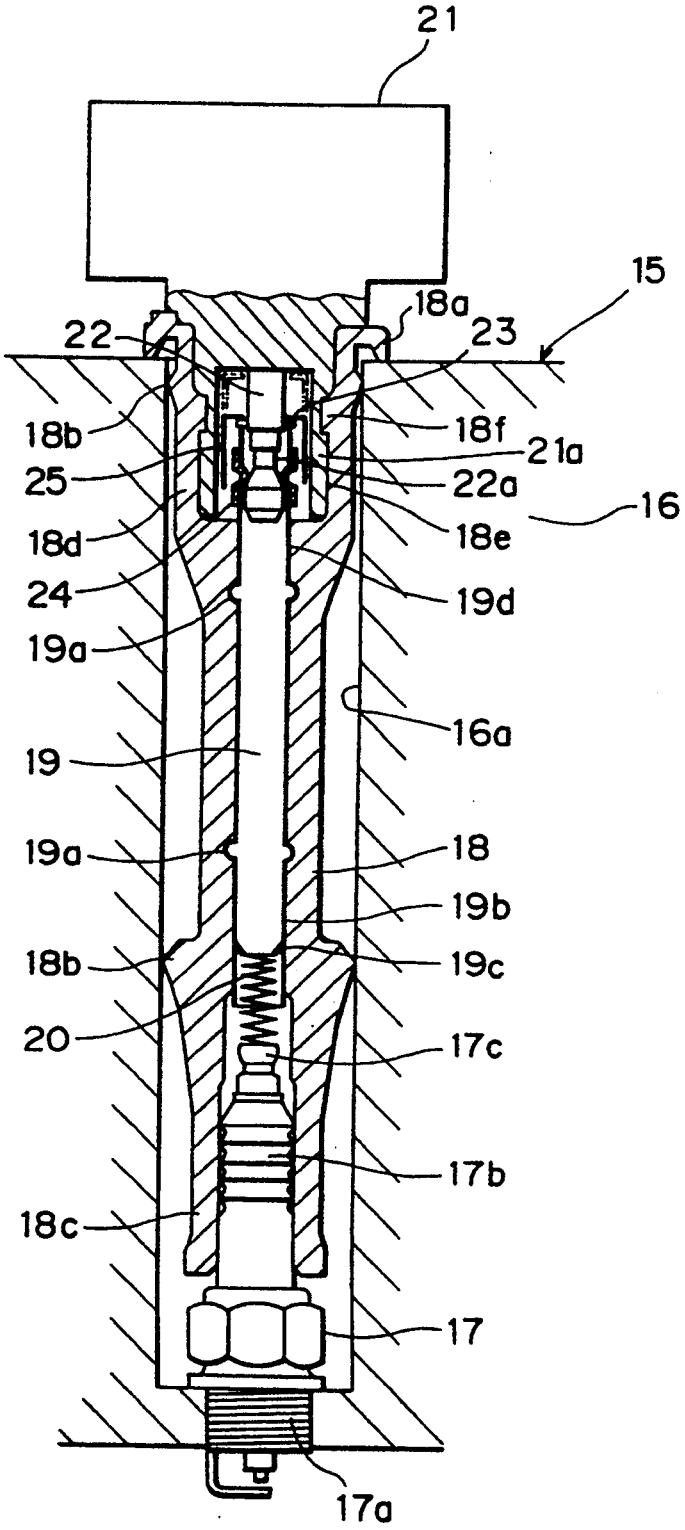
FIG. 1 is a sectional view showing a coupling construction of an ignition device according to an embodiment of the present invention.

Before the description of the present invention proceeds, it is to be noted that like parts are designated by like reference numerals throughout the accompanying drawings.

Referring to FIG. 1, the coupling construction according to the embodiment of the present invention is described below with reference to FIGS. 1 and 2. An installing hole 16a is formed in a cylinder head 15 of an engine 16. An ignition plug 17 is fixed to the bottom portion of the installing hole 16a by means of a screw portion 17a thereof. An insulating portion 17b and a terminal 17c are installed on the ignition plug 17.

A cylindrical insulator 18 made of rubber is inserted into the installing hole 16a of the cylinder head 15. The interval between the insulator 18 and the upper surface of the cylinder head 15 is sealed by an upper flange portion 18a, and the interval between the peripheral surface of the insulator 18 and the inner surface of the installing hole 16a is also sealed by a projection 18b formed on the peripheral surface of the insulator 18. A lower portion 18c of the insulator 18 engages an insulating portion 17b of the ignition plug 17 so as to seal the interval between inner surface of the lower portion 18c and the peripheral surface of the insulating portion 17b.

The inner diameter of the lower portion 18c of the insulator 18 is small for the lower portion 18c to tighten the insulating portion 17b of the ignition plug 17. In this manner, the performance of the electrical sealing between the insulator 18 and the ignition plug 17 is increased.

A pipe-shaped electric conductor 19 is inserted into the insulator 18, and a plurality of projections 19a of the electric conductor 19 cuts into the insulator 18, thus fixing the electric conductor 19 to the insulator 18.

A spring 20 is installed on a projection 19c projecting inward from the lower portion 19b of the electric conductor 19 so as to bring the spring 20 in contact with the terminal 17c of the ignition plug 17, thus electrically connecting the electric conductor 19 and the terminal 17c with each other.

Figure 2:
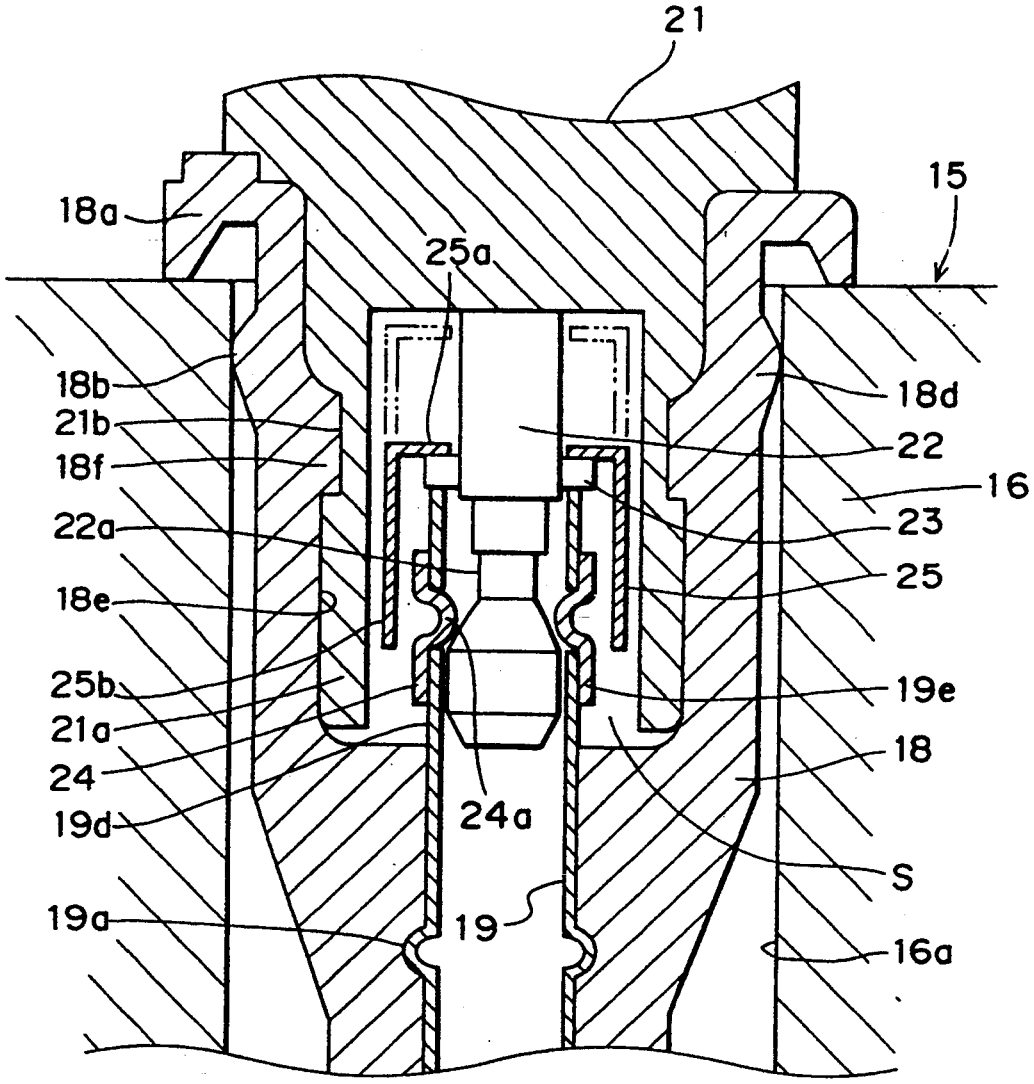
FIG. 2 is a sectional view showing principal portions of the coupling construction shown in FIG. 1.

As shown in detail in FIG. 2, a spot facing portion 18e of a large diameter is formed on an upper portion 18d of the insulator 18. The upper portion 19d of the electric conductor 19 projects in a predetermined length in the spot facing portion 18e. A cylindrical inserting portion 21a disposed at a lower portion of the ignition coil 21 is inserted downward into the spot facing portion 18e. A convex portion 18f projecting inward from the spot facing portion 18e engages a concave portion 21b formed on the peripheral surface of the inserting portion 21a, thus retaining the inserting portion 21a at the predetermined position.

A cylindrical high-voltage terminal 22, integral with the ignition coil 21, to be inserted into the upper portion 19d of the electric conductor 19 is provided inside the inserting portion 21a of the ignition coil 21. A space (S) is formed between the peripheral surface of the high-voltage terminal 22 and the inner peripheral surface of the inserting portion 21a.

An engaging concave 22a is formed on the peripheral surface of the high-voltage terminal 22. A through-hole 19e corresponding to the engaging concave 22a of the high-voltage terminal 22 is formed on the upper portion 19d of the electric conductor 19. A stopper ring 23 disposed above the engaging concave 22a is fixed to the peripheral surface of the high-voltage terminal 22.

An elastic engaging ring 24 which engages the peripheral surface of the upper portion 19d of the electric conductor 19 is provided. An engaging convex portion 24a which projects inward toward the high-voltage terminal 22 through the through-hole 19e is formed on the engaging ring 24. Due to its contraction, the engaging convex portion 24a engages the engaging concave portion 22a of the high-voltage terminal 22 inserted downward into the upper portion 19d of the electric conductor 19. With the downward movement of the high-voltage terminal 22 inserted into the upper portion 19d of the electric conductor 19, the high-voltage terminal 22 is pressed against the engaging convex portion 24a, thus expanding or increasing the diameter of the engaging convex portion 24a because the engaging convex portion 24a is elastic. With a further downward movement of the high-voltage terminal 22, the engaging concave portion 22a becomes opposed to the engaging convex portion 24a, thus reducing the diameter of the engaging convex portion 24a contractionally.

The bottom portion 25a of a cylindrical moving sleeve 25 engages the peripheral surface of the high-voltage terminal 22. The moving sleeve 25 is movable due to dead load between a locking position (see solid line) at which a cylindrical portion 25b thereof removably engages the peripheral surface of the engaging ring 24, with the bottom portion 25a in contact with the stopper ring 23 and an unlocking position (see two-dot chain line) at which the cylindrical portion 25b disengages from the peripheral surface of the engaging ring 24.

The inner diameter of the moving sleeve 25 is set so that a slight gap is provided between the peripheral surface of the engaging ring 24 and the inner surface of the moving sleeve 25. In this manner, the diameter of the engaging convex portion 24a can be prevented from expansionarily being increased more than a predetermined length.

Figures 3A, 3B, 3C, 3D:
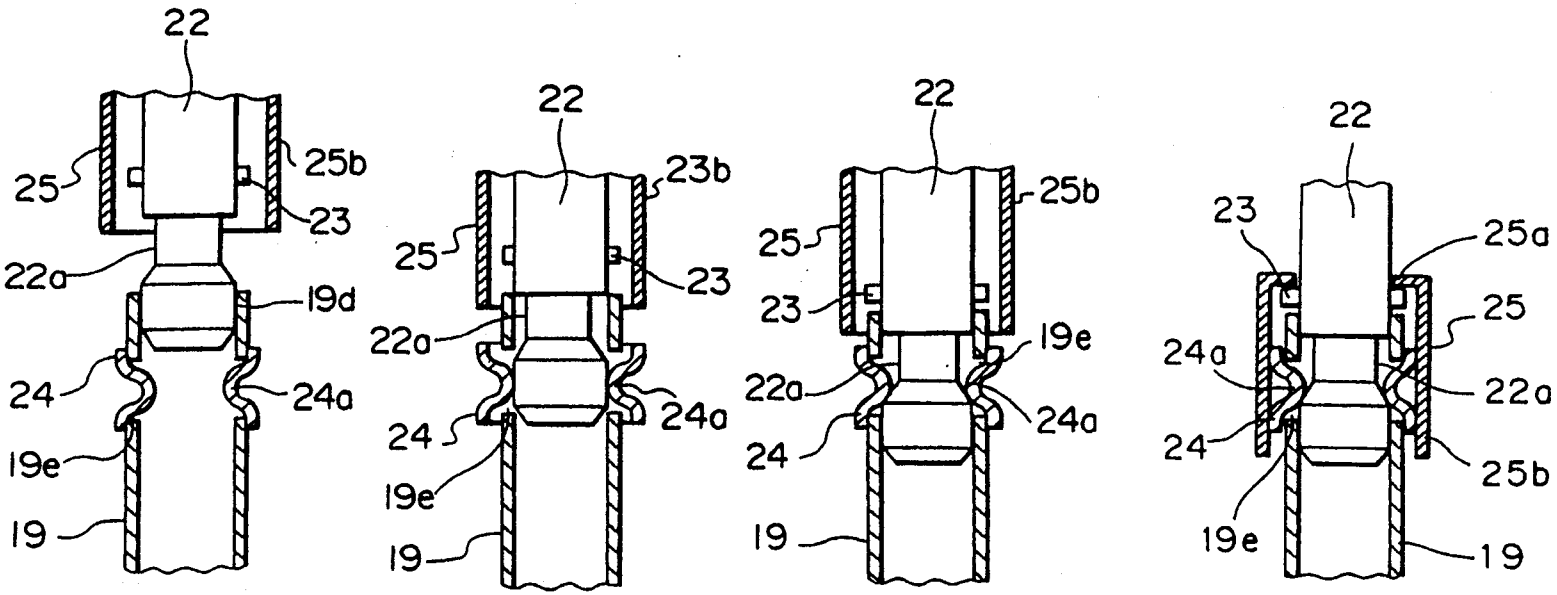
FIG. 3A–3D are explanatory views showing the order of assembling the coupling construction.
Figure 4:
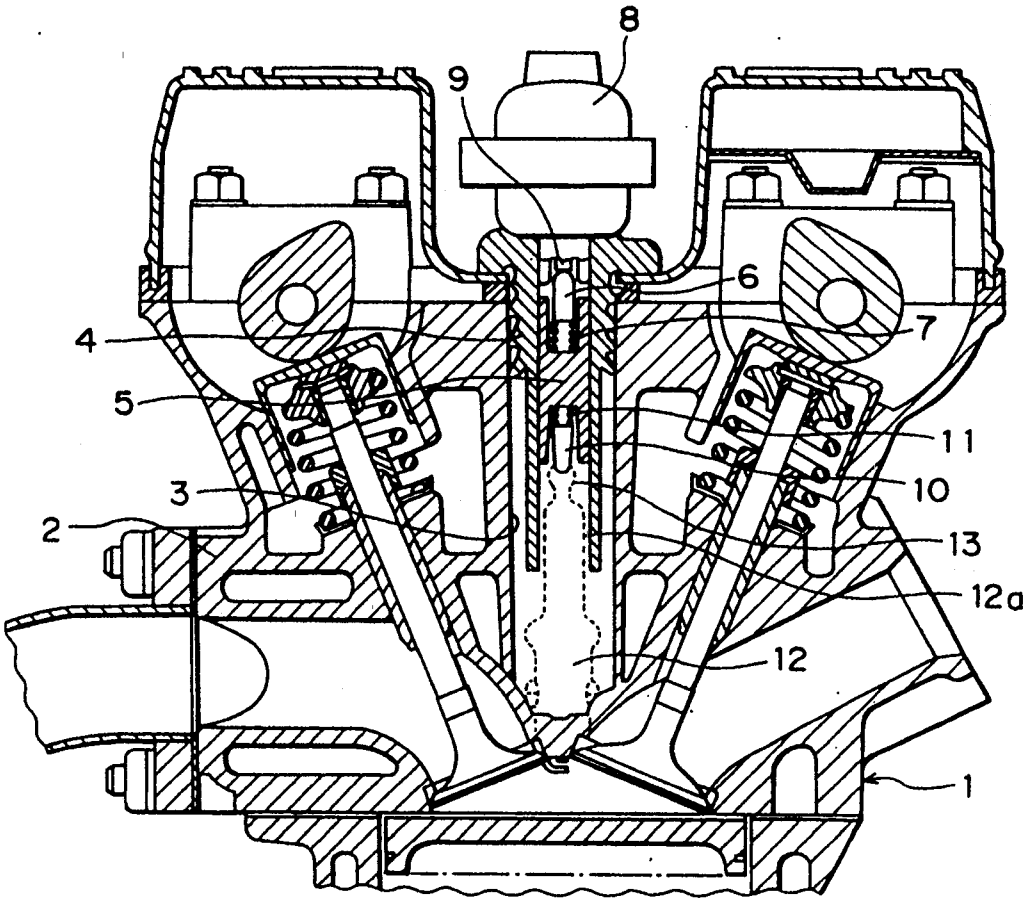
FIG. 4 is a sectional view showing the coupling construction of the conventional ignition device.

In the above-described construction, as shown in FIG. 3(A), in assembling an ignition device, when the high-voltage terminal 22 of the ignition coil 21 is positioned upward, the moving sleeve 25 moves to the unlocking position due to dead load. In this condition, the high-voltage terminal 22 is inserted downward into the upper portion 19d of the electric conductor 19 fixed to the insulator 18.

The electric conductor 19 is engaged by the engaging ring 24 before the high-voltage terminal 22 is inserted into the upper portion 19d of the electric conductor 19 so as to project the engaging convex portion 24a inward toward the high-voltage terminal 22 through the through-hole 19e. While the high-voltage terminal 22 is being inserted into the electric conductor 19, as shown in FIG. 3(B), the high-voltage terminal 22 is pressed against the engaging convex portion 24a, thus increasing the diameter of the engaging convex portion 24a expanding or. Then, as shown in FIG. 3(C), when the engaging convex portion 24a becomes opposed to the engaging concave portion 22a of the high-voltage terminal 22, the diameter of the engaging convex portion 24a is reduced contractionally. In this manner, the electric conductor 19 and the high-voltage terminal 22 are coupled with each other by the engaging ring 24.

At this time, the spot facing portion 18e of the insulator 18 is inserted into the inserting portion 21a of the ignition coil 21 and thus the ignition coil 21 and the insulator 18 are coupled with each other.

Thereafter, as shown in FIG. 3(D), the high-voltage terminal 22 of the ignition coil 21 is placed at a position as shown in FIG. 1. When the insulator 18 has been inserted into the installing hole 16*a* of the cylinder head 16, the moving sleeve 25 moves to the locking position due to dead load. As a result, the cylindrical portion 25*b* of the moving sleeve 25 removably engages the peripheral surface of the engaging ring 24. As a result, the diameter of the engaging convex portion 24*a* of the engaging ring 24 is prevented from being expansionarily increased. Accordingly, the engaging convex portion 24*a* is prevented from disengaging from the engaging concave portion 22*a* of the high-voltage terminal 22.

As described above, as shown in FIG. 1, the insulator 18 is inserted into the installing hole 16*a* of the cylinder head 16, and the lower portion 18*c* of the insulator 18 is engaged by the insulating portion 17*b* of the ignition plug 17. In removing the insulator 18 from the installing hole 16*a*, the ignition coil 21 is moved upward by hand. As a result, the diameter of the engaging convex portion 24*a* of the engaging ring 24 increases expansionarily and the engaging convex portion 24*a* is locked by the moving sleeve 25 so that the engaging convex portion 24*a* does not disengage from the engaging concave portion 22*a* of the high-voltage terminal 22. Therefore, the insulator 18 can be easily removed from the installing hole 16*a*. At this time, the high-voltage terminal 22 is not uncoupled from the insulator 18 and thus neither the insulator 18 nor the electric conductor 19 remains disposed in the installing hole 16*a* unlike the conventional coupling construction.

As described previously, the inner diameter of the lower portion 18*c* of the insulator 18 is set to be small for the lower portion 18*c* to tighten the insulating portion 17*b* of the ignition plug 17. In this manner, the coupling construction provides a preferable electrical sealing performance between the insulator 18 and the ignition plug 17. There is no possibility that the high-voltage terminal 22 is uncoupled from the insulator 18 because the engaging convex portion 24*a* is locked by the moving sleeve 25. Thus, the ignition device can be reliably used.

At the locking position, the moving sleeve 25 removably locks the engaging ring 24 by the engagement between the cylindrical portion 25*b* thereof and the peripheral surface of the engaging ring 24. At the unlocking position, the moving sleeve 25 gives no influence for the engaging ring 24 to couple the high-voltage terminal 22 and the electric conductor 19 with each other. Accordingly, the force of inserting the high-voltage terminal 22 into the electric conductor 19 is not increased and thus the former can be efficiently inserted into the latter.

As apparent from the foregoing description, in the coupling construction for coupling the ignition coil for use in an internal combustion engine and the cylindrical electric conductor with each other, the shaft-shaped high-voltage terminal is inserted into the cylindrical electric conductor. The engaging ring engages the peripheral surface of the electric conductor. The engaging convex portion of the engaging ring projecting inward toward the high-voltage terminal through the through-hole engages the engaging concave portion of the high-voltage terminal due to the contraction of the engaging ring. After the high-voltage terminal and the electric conductor are coupled with each other, the moving sleeve removably engages the peripheral surface of the engaging ring, thereby preventing the diameter of the engaging convex portion of the engaging ring from increasing expansionarily more than a predetermined length. Accordingly, engaging convex portion of the engaging ring can be prevented from disengaging from the engaging concave portion of the high-voltage terminal.

Therefore, when the high-voltage terminal is moved upward by hand, the engaging convex portion of the engaging ring is locked by the moving sleeve so that the engaging convex portion does not disengage from the engaging concave portion of the high-voltage terminal. Accordingly, even though the ignition plug is tightened strongly by the insulator, the high-voltage terminal is not uncoupled from the electric conductor. Thus, the coupling construction provides a preferable electrical sealing performance between the insulator and the ignition plug. There is no possibility that the high-voltage terminal is uncoupled from the insulator because the engaging convex portion is locked by the moving sleeve. Thus, the ignition device can be reliably used.

At the locking position, the moving sleeve locks the engaging ring by the engagement between the cylindrical portion thereof and the peripheral surface of the engaging ring. At the unlocking position, the moving sleeve gives no influence for the engaging ring to couple the high-voltage terminal and the electric conductor with each other. Accordingly, the force of inserting the high-voltage terminal into the electric conductor is not increased and thus high-voltage terminal can be efficiently inserted into the electric conductor.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A coupling construction for coupling a shaft-shaped high-voltage terminal of an ignition coil for use in an internal combustion engine and a cylindrical electric conductor with each other with the high-voltage terminal inserted into a first end of the cylindrical electric conductor, a second end of the cylindrical electric conductor being detachably connected to another electric component, comprising:

an engaging concave portion formed on the peripheral surface of the high-voltage terminal;

a through-hole, formed on the electric conductor, corresponding to the engaging concave portion of the high-voltage terminal;

an engaging ring which engages the peripheral surface of the electric conductor and has an engaging convex portion projecting inward toward the high-voltage terminal through the through-hole and engaging the engaging concave portion of the high-voltage terminal due to the contraction of the engaging ring;

a moving sleeve, for preventing the diameter of the engaging convex portion of the engaging ring from expanding, the moving sleeve being movable between a locking position at which the moving sleeve engages the peripheral surface of the engaging ring and an unlocking position at which the moving sleeve disengages therefrom; and a spring connected to the electric conductor, the spring electrically connecting the electric conductor to the another electric component.

2. The coupling construction as defined in claim 1, further comprising an insulator, the electric conductor being inserted into the insulator.

3. The coupling construction as defined in claim 2, wherein the insulator tightly surrounds the another electric component.

4. The coupling construction as defined in claim 3, wherein the another electric component is an ignition plug.

5. A coupling construction for coupling a shaft-shaped high-voltage terminal of an ignition coil for use in an internal combustion engine and a cylindrical electric conductor with each other with the high-voltage terminal inserted into a first end of the cylindrical electric conductor, a second end of the cylindrical electric conductor being detachably connected to an ignition plug, comprising:

an engaging concave portion formed on the peripheral surface of the high-voltage terminal;

a through-hole, formed on the electric conductor, corresponding to the engaging concave portion of the high-voltage terminal;

an engaging ring which engages the peripheral surface of the electric conductor and has an engaging convex portion projecting inward toward the high-voltage terminal through the through-hole and engaging the engaging concave portion of the high-voltage terminal due to the contraction of the engaging ring;

a moving sleeve, for preventing the diameter of the engaging convex portion of the engaging ring from expanding, the moving sleeve being movable between a locking position at which the moving sleeve engages the peripheral surface of the engaging ring and an unlocking position at which the moving sleeve disengages therefrom; and an insulator, the electric conductor being inserted into the insulator, wherein the insulator tightly surrounds the ignition plug.

6. The coupling construction as defined in claim 5, further comprising a spring connected to the electric conductor, the spring electrically connecting the electric conductor to the ignition plug.

* * * * *